United States Patent [19]

Abe

[11] Patent Number: 4,842,119

[45] Date of Patent: Jun. 27, 1989

[54] SENSOR COIL FOR DISCRIMINATING COIN ACCEPTOR OR REJECTOR

[75] Inventor: Hiroshi Abe, Tokyo, Japan

[73] Assignee: Asahi Seiko Kabushiki Kaisha, Tokyo, Japan

[21] Appl. No.: 132,264

[22] Filed: Dec. 14, 1987

[30] Foreign Application Priority Data

Jun. 18, 1985 [JP] Japan ..... 60-130810

[51] Int. Cl.[4] ..... G07D 5/00

[52] U.S. Cl. ..... 194/317; 336/225

[58] Field of Search ..... 194/317, 318, 319, 334; 335/282; 324/318, 322; 336/225, 228, 226, 227, 232; 219/228

[56] References Cited

U.S. PATENT DOCUMENTS

| | | | |
|---|---|---|---|
| 1,984,433 | 12/1934 | Runge | 336/226 |
| 2,013,854 | 9/1935 | Ruelland | 219/228 X |
| 4,361,218 | 11/1982 | Van Dort | 194/317 |
| 4,601,380 | 7/1986 | Dean et al. | 194/318 |

FOREIGN PATENT DOCUMENTS

| | | | |
|---|---|---|---|
| 171104 | 9/1984 | Japan | 335/282 |

OTHER PUBLICATIONS

Japanese Utility Model Laid Open No. 53-56,897, Tateishi Denki Kabushiki Kaisha.

Japanese Utility Model Publication No. 56-12,693, Sanyo Jido Hanbaiki Kabushiki Kaisha.

*Primary Examiner*—Thomas J. Kozma

*Attorney, Agent, or Firm*—Arnold, White & Durkee

[57] ABSTRACT

A sensor coil for discriminating a coin has an oval configuration in a section parallel to the side of a coin passing through a coin passage, with one end in the longitudinal direction of the oval configuration having a large radius of curvature and the other end having a small radius of curvature. The oval shaped sensor coil is able to accurately discriminate a genuine coin or coins from others having different diameters and different materials.

4 Claims, 4 Drawing Sheets

SENSOR COIL FOR DISCRIMINATING COIN ACCEPTOR OR REJECTOR

BACKGROUND OF THE INVENTION

The present invention relates to a sensor coil for discriminating a coin, in particular to a sensor coil for use in coin acceptors or rejectors installed in coil operated vending machines, game machines or other equipment or machines for discriminating a genuine coin or coins of a particular denomination from spurious coins or slugs.

Such a sensor coil has been used in the form of a proximity switch wherein one sensor coil is arranged on one side of a coin passage or a slot switch wherein two sensor coils are opposedly arranged on both sides of the coil passage. The sensor coil may be connected with an oscillator circuit, a rectifier circuit, a Schmidt circuit, an output circuit or other circuit such that when a magnetic field generated by the sensor coil is crossed by a coin which is passing through the coin passage, an induction of the coil varies and this variation of the induction is detected to discriminate the material or the dimension of the coin.

Heretofore, such a sensor coil used in the aforementioned manner has been generally formed in the form of a circular sensor coil as described in Japanese Utility Model Publication No. 56-12,693 or in the form of an elliptical sensor coil as described in Japanese Utility Model Laid-Open No. 53-56,897.

It was found, however, that it is very hard for such known circular and elliptical sensor coils to correctly discriminate coins having different diameters, even if coins are made of the same material.

That is, differences between variations of reactance of the circular sensor coil caused when coins A, B and C of different diameters but the same material cross the magnetic field of the circular sensor coil (see FIG. 6) are expressed only by differences in height and width of the peak variations of variation curves "a', "b" and "c" of the similar shape (see FIG. 7). Further, the peak variations of the coil reactance caused by the coins A, B and C having different diameters occur at the same time position on a time coordinate axis. Furthermore, if the diameter and position of the circular coil are not pertinent for all coins to be discriminated, the peak variations can not be distinguished from each other as is noted by comparing the variation curves "b" and "c" (FIG. 7), resulting in that the coins B and C can not be discriminated by the peak variations.

The elliptical sensor coil (see FIG. 8) also has drawbacks similar to the circular sensor coil since the peak variations of the coil reactance caused by different coins A, B and C occur in the same time position except that the peak variations have increased different widths (see variation curves "a", "b" and "c" in FIG. 9).

With the aim of removing the drawbacks of the above circular sensor coil, Japanese Utility Model Publication No. 56-12,693 proposes an arrangement of a coin position detecting means at a position away from the center of the circular sensor coil in the left or right direction along a coin guide rail in the coil passage to ensure a difference between variations of the coil reactance caused by coins having different diameters.

However, the difference between variations of the coin reactance caused by coins having different diameters is provided at substantially the same time position and is relatively small. Accordingly, high accuracy of measurement is required for surely detecting such a small difference between the variations.

Moreover, in order to correctly discriminate coins having different diameters by use of the circular or the elliptical sensor coil, the coins to be discriminated should be made of substantially the same material. It is therefore necessary to provide an additional sensor coil or coils for selecting coins of the same material.

SUMMARY OF THE INVENTION

It is an object of the present invention to provide a sensor coil showing a variation curve of coil reactance which has a different pattern distinguishable from other coins having different diameters, and having a peak variation which occurs at a different time position to improve the accuracy of discrimination.

The sensor coil for discriminating a coin according to the present invention has an oval configuration in a section parallel to the side of a coin passing through a coin passage, with one end in the longitudinal direction of the oval configuration having a large radius of curvature and the other end having a small radius of curvature.

A preferred embodiment of the sensor coil according to the present invention is characterized in that the large radius of curvature at one end of the oval configuration is substantially the same as the radius of a coin having the maximum diameter among coins to be discriminated, and the small radius of curvature at the other end is substantially the same as the radius of a coin having the minimum diameter among coins to be discriminated.

BRIEF DESCRIPTION OF THE DRAWINGS

The invention, the object and feature of the invention and further objects, features and advantages thereof will be better understood from the following description with reference to the accompanying drawings, in which.

DESCRIPTION OF THE PREFERRED EMBODIMENT

Figure 1:
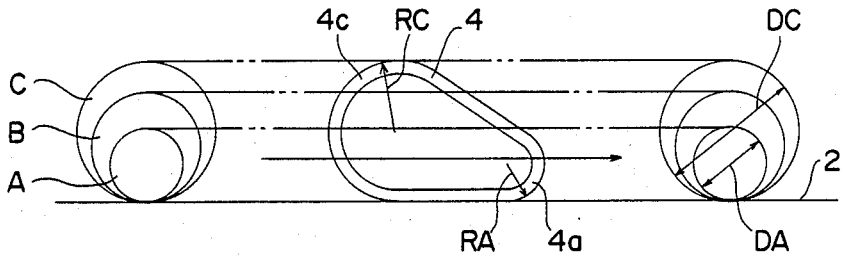
FIG. 1 is a schematic view of a sensor coil according to the present invention.

With reference to FIG. 1, a sensor coil 4 has a configuration of an oval, that is a figure of the shape of the longitudinal section of an egg. The sensor coil 4 may be used in a pair with another identical sensor coil in such a manner that the identical sensor coils are secured to the opposite side walls respectively which are spaced apart from each other to define a coin passage therebetween, and the section of oval configuration of each of the sensor coils is parallel to the side of a coin rolling on a guide rail 2 in the coin passage. The sensor coil 4 has one end 4c of a large radius of curvature RC which corresponds to the radius of a coin C having the maximum diameter among a plurality of coins A, B and C of different denomination to be discriminated, and the other end 4a of a small radiùs of curvature RA which corresponds to the radius of the coin A having the minimum diameter.

When each of coins A, B and C passes through the coin passage at the same speed by rolling on the guide rail 2 and crosses a magnetic field between the opposed oval sensor coils 4 as shown in FIG. 1, the coil reactance varies for each of the coins as shown by variation curves "a", "b" and "c" (FIG. 2), having peak variations at time positions A, B and C, respectively. The variations of the coil reactance are detected in a resonance portion of an L-C oscillator circuit 6 connected the sensor coils 4, see FIG. 4.

Figure 2:
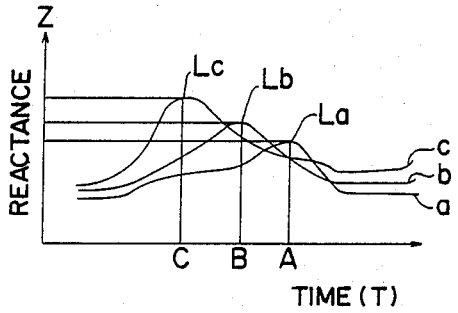
FIGS. 2 and 3 show characteristic curves of variations of reactance when three representative coins of different denominations cross a magnetic field of the sensor coil as shown in FIG. 1.

As shown in FIG. 2, the peak reactance La caused by the small coin A occurs at the time position A corresponding the center of the small radius of curvature RA at one end 4a of sensor coil 4, and the peak reactance Lc caused by the large coin C occurs at the time position C corresponding to the center of the large radius of curvature RC of the other end 4c of sensor coil 4. The peak reactance Lb caused by the middle coin B having a diameter larger than that of the small coin A and smaller than that of the large coin C occurs at the middle time position B corresponding to the diameter of the coin B.

It can be seen that the peak variation of the coil reactance for each of the coins having different diameters occurs at a different time position which is accounted from the beginning of the variation of the coil reactance caused when the coins pass through the coin passage at the same speed. Thus, the oval coil according to the present invention provides a variation curve for a given diameter coin having a particular pattern distinguishable from other coins having different diameters. Accordingly, it is possible to accurately discriminate a coin by detecting the variations at various time positions by using clock pulses generated from a clock counter which is started when the coil reactance begins to be varied by the coin, and by comparing the detected variations with the predetermined variations of the reference variation curve of the genuine coin after adjusting the peak variation time position which is varies by the speed of the coin.

The maximum difference can be easily obtained between the peak variations of the coin reactances by comparing the small radius of curvature RA and the large radius of curvature RC to the radius of the coin A having the minimum diameter and the rudius of the coin C having the maximum diameter to be discriminated, respectively.

As mentioned above, when coins made of the same material pass the coin passage at the same speed, the time position at which the peak reactance occurs is different for each of coins having different diameters. Accordingly, a difference in the peak reactance at the same time position may be easily detected as the difference of the material composing the coin having the same diameter.

Thus, the oval sensor coil according to the present invention can easily and accurately discriminate a genuine coin or coins from coins having different diameters and different material.

Such a discrimination of both the dimension and material of a coin may be achieved by detecting variation of two parameters provided by means of the current being proportional to voltage drop and by means of the frequency shift caused when the coin passes between a pair of the oval sensor coils.

Figure 4:
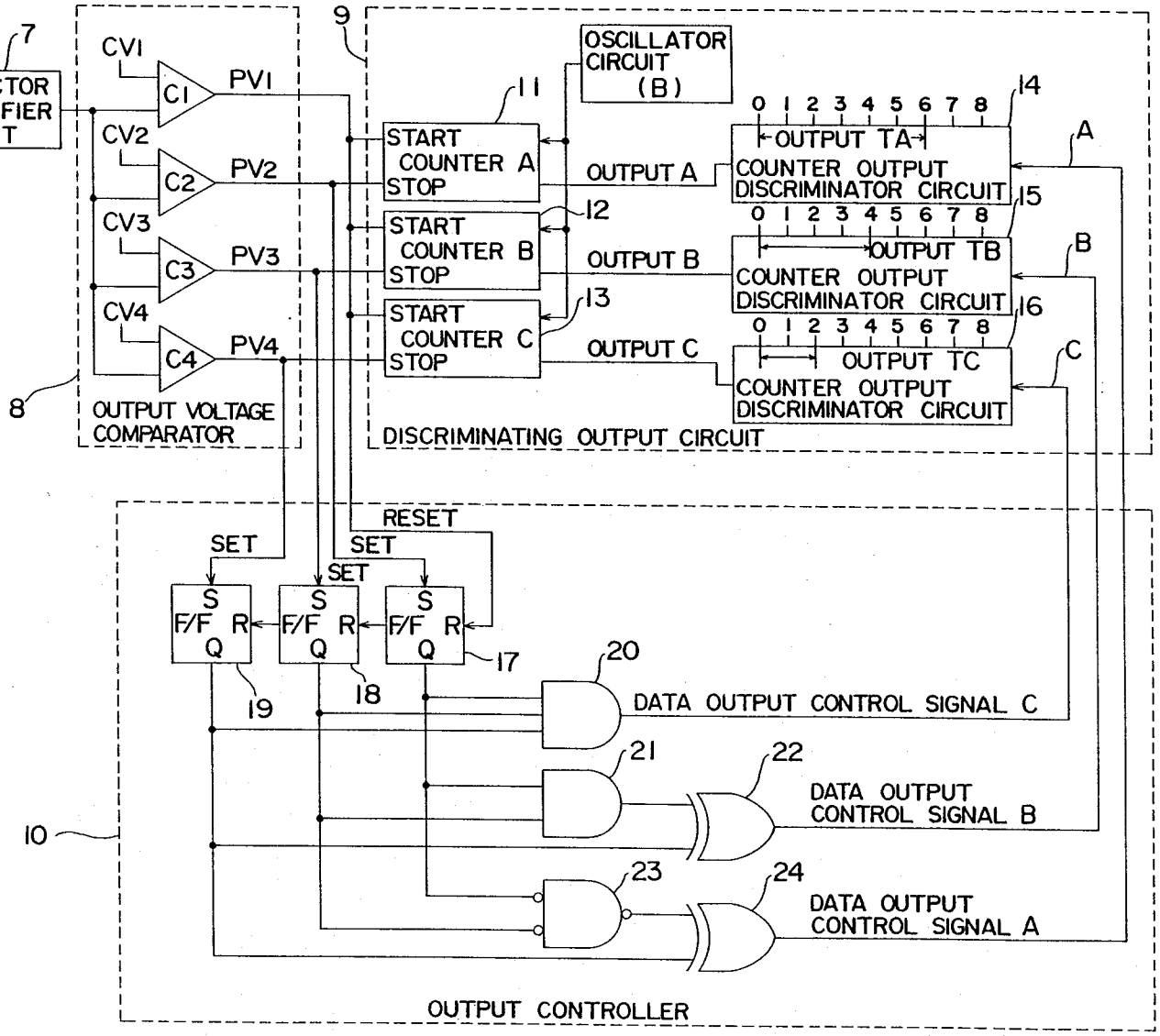
FIG. 4 is a circuit diagram of an example of the preferred embodiment of the present invention.

FIG. 4 shows an embodiment of a circuit for discriminating three coins A, B and C of different denominations by using a pair of oval sensor coils 4 according to the present invention. The oval sensor coils are opposedly arranged on the opposite sides of the coin passage 5.

Figure 5:
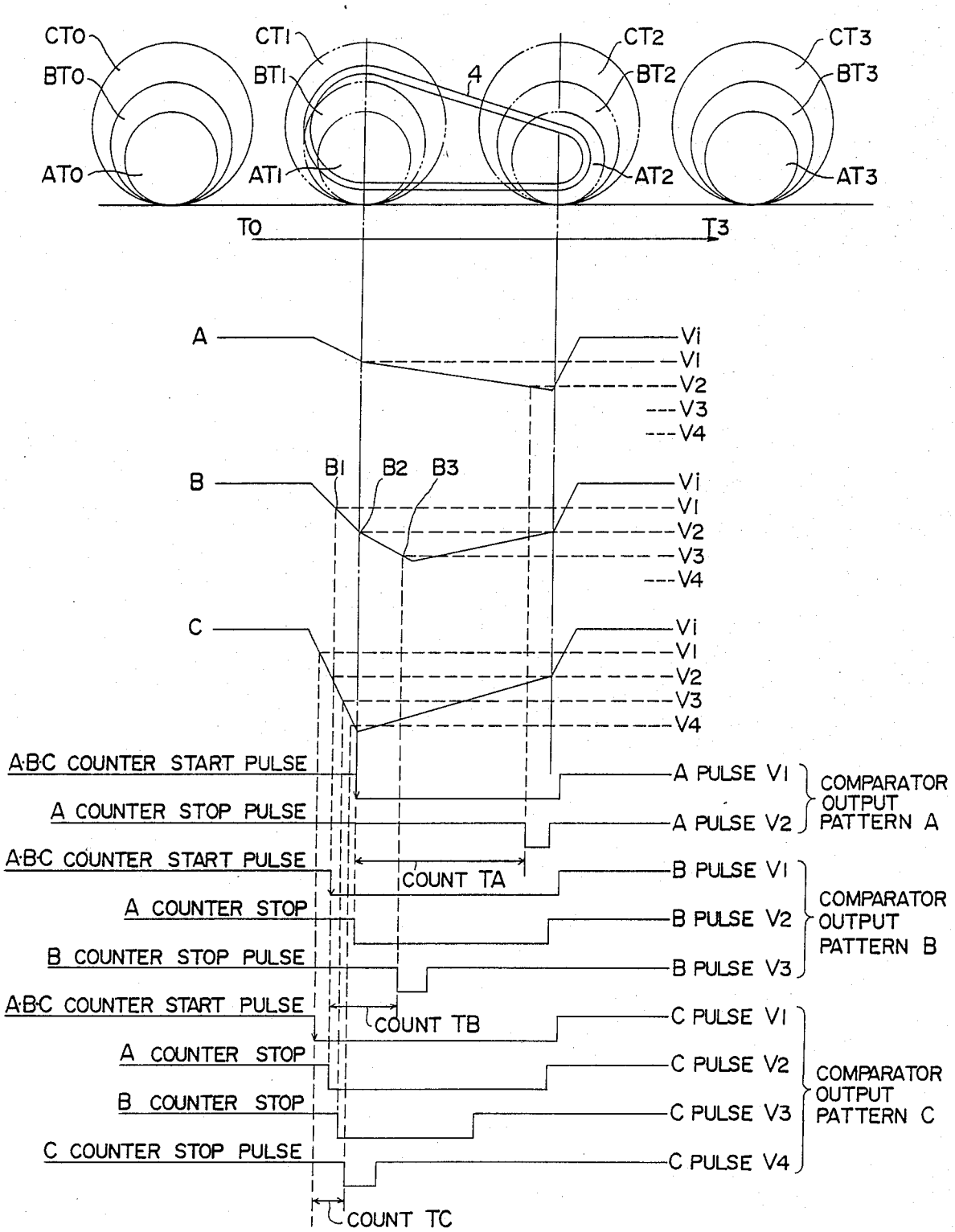
FIG. 5 is a timing diagram of signals employed in the circuit of FIG. 4.
Figure 7:
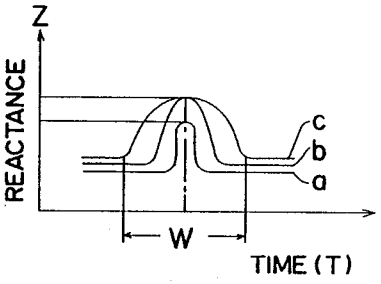
FIG. 7 PRIOR ART
FIG. 7 shows characteristic curves of variations of reactance caused by the sensor coil shown in FIG. 6.
Figure 9:
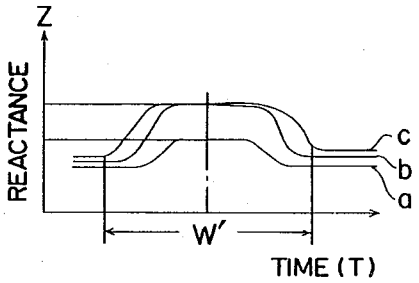
FIG. 9 PRIOR ART
FIG. 9 shows characteristic curves of variations of reactance caused by the sensor coil shown in FIG. 8.
Figure 6:
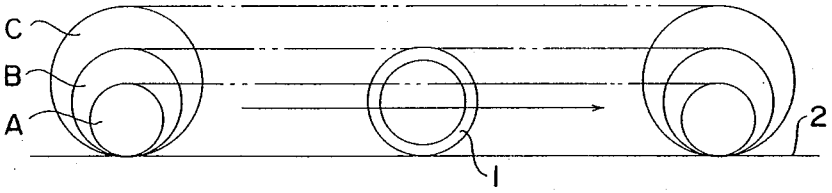
FIG. 6 PRIOR ART
FIG. 6 is a schematic view of a conventional circular sensor coil.
Figure 8:
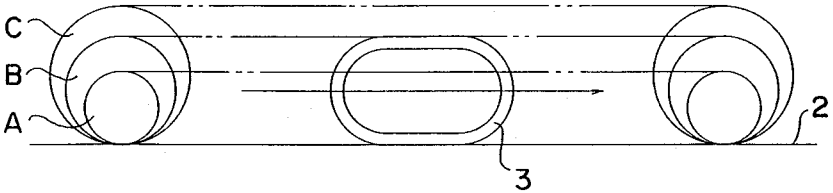
FIG. 8 PRIOR ART
FIG. 8 is a schematic view of a known elliptical sensor coil.

In the circuit shown in FIG. 4, the variations of coil inductance caused when the coins A, B and C pass between a pair of the oval sensor coils 4, 4 are detected by the oscillator circuit 6, and then those detected signals are rectified in a rectifier circuit 7 to provide signals having wave shapes A, B and C as shown in FIG. 5. In FIG. 5, $V_1$ is the initial voltage and $V_2$–$V_4$ are reference voltages.

As shown in FIG. 4, the rectified signals are transferred from the rectifier circuit 7 to an output voltage comparator circuit 8 which includes a plurality of voltage comparators $C_1$–$C_4$ to which reference voltages $CV_1$–$CV_4$ are input. Each of the voltage comparators $C_1$–$C_4$ compares the voltage of an input signal from the rectifier circuit 7 with one of the reference voltages $CV_1$–$CV_4$, respectively, and outputs one of signals $PV_1$–$PV_4$ when the voltage of the input signal is higher than the reference voltage.

The output signals from the voltage comparators $C_1$–$C_4$ are input to a discriminator circuit 9 wherein each of the output signals is measured with respect to a time coordinate axis, and also to an output control circuit 10, from which control signals are output by the differences of voltages output from the comparator.

The discriminator circuit 9 includes a plurality of counters 11, 12 and 13 and is arranged such that when the output signal $PV_1$ from the voltage comparator $C_1$ is input to all the counters 11, 12 and 13 whose counters start simultaneously and when the output signals $PV_2$, $PV_3$ and $PV_4$ from the voltage comparators $C_2$–$C_4$ are input to the counters 11, 12 and 13, respectively, the counter 11, 12 or 13 stops respectively. When output signals A, B and C from the counters 11, 12 and 13 are input to discriminating circuits 14, 15 and 16, respectively, for discriminating the outputs from the counters and an enable signal A, B or C from the output control circuit 10 is input to the discriminating circuit 14, 15 or 16, a discriminating signal for coin A, B or C is output from the discriminating circuit 14, 15 or 16.

An operation of the aforementioned circuit will be described for the case of discriminating the coin B.

When the coin B passes between the sensor coils 4, 4, a variation of coil reactance as shown by the variation curve "b" in FIG. 2 is detected in the oscillator circuit 6, and this detected signal is rectified by the rectifier circuit 7 into a waveform as shown by B in FIG. 5.

At a point $B_1$ on the waveform B, the reference voltage $V_1$ is input to the comparator $C_1$, thereby outputting signal $PV_1$ from the comparator $C_1$ resulting in starting the counters 11, 12 and 13. Then, at a point $B_2$ on the waveform B, the reference signal $V_2$ is input to the comparator $C_2$, thereby outputting the signal $PV_2$ from the comparator $C_2$. The signal $PV_2$ is input to the counter 11 and a flip-flop 17 in the circuit 10, thereby stopping the counter 11. Further, at a point $B_3$ on the waveform, reference voltage $V_3$ is input to the comparator $C_3$, thereby outputting the signal $PV_3$ from the comparator $C_3$.

This output signal $PV_3$ is input to the counter 12 and a flip-flop 18 in the circuit 10, thereby stopping the counter 12 and inputting the output signal 13 to the counter output discriminating circuit 15.

When the output signals $PV_2$ and $PV_3$ are input to the flip-flops 17 and 18 in the output controlling circuit 10, respectively, but no signal is input to a flip-flop 19 in the circuit 10, an enable signal B is output from an OR gate 22, thereby outputting genuine signal for accepting the coin B from the counter output discriminating circuit 15.

Figure 3:
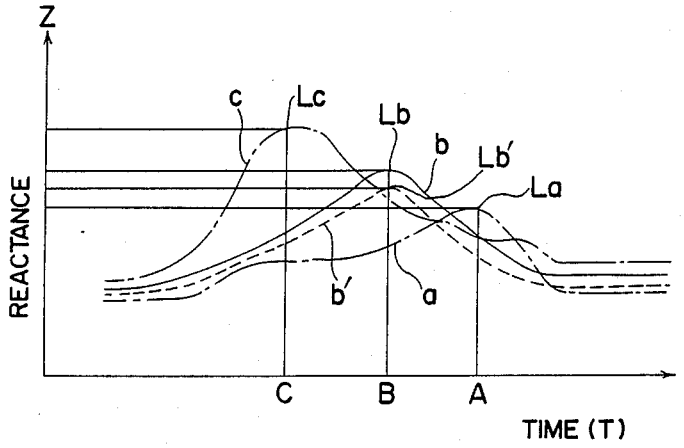

When a coin B having the same diameter as that of the coin B, but made of a material different from that of the coin B, passes between the oval sensor coils 4, 4, the coil reactance may be varied as shown by a variation curve "b'" in FIG. 3. The peak reactance Lb' for the coin B' may be lower than the peak reactance Lb for the genuine coin B, and therefore the input voltage to the comparator $C_3$ is lower than the reference voltage $CV_3$ resulting in no output from the comparator $C_3$ and no genuine signal from the counter output discriminating circuit 15.

What is claimed is:

1. A coin discriminating inductive sensor coil for use in a coin acceptor comprising a coin passage, a guide rail along which coins pass on their edges and substantially in a predetermined plane through the coin passage, and at least one inductive sensor coil arranged at at least one of opposite sides of the coin passage to produce an oscillating magnetic field in the coin passage and to have its coil inductance varied by a coin travelling in the coin passage, said coin discriminating inductive sensor coil having an oval configuration with one end in the longitudinal direction of the oval configuration having a large radius of curvature and the other end in the longitudinal direction of the oval configuration having a small radius of curvature, and said coin discriminating inductive sensor coil being so arranged that the major axis of its oval configuration is extended in the direction of the path of a coin along the guide rail and substantially parallel with said predetermined plane.

2. A sensor coil as claimed in claim 1, wherein the large radius of curvature at said one end of the oval configuration is substantially the same as the radius of a coin having the maximum diameter among coins to be discriminated, and the small radius of curvature at said other end of the oval configuration is substantially the same as the radius of a coin having the minimum diameter among coins to be discriminated.

3. A coin acceptor comprising a coin passage, a guide rail along which coins pass on their edges and substantially in a predetermined plane through the coin passage, and at least one inductive sensor coil arranged at at least one of opposite sides of the coin passage to produce an oscillating magnetic field in the coin passage and to have its coil inductance varied by a coin travelling in the coin passage, said sensor coil having an oval configuration with one end in the longitudinal direction of the oval configuration having a large radius of curvature and the other end in the longitudinal direction of the oval configuration having a small radius of curvature, and said sensor coil being so arranged that the major axis of its oval configuration is extended in the direction of the path of a coin along the guide rail and substantially parallel with said predetermined plane.

4. A coin acceptor as claimed in claim 3, wherein the large radius of curvature of said one end of the oval configuration is substantially the same as the radius of a coin having the maximum diameter among coins to be discriminated, and the small radius of curvature at said other end of the oval configuration is substantially the same as the radius of a coin having the minimum diameter among coins to be discriminated.

* * * * *